US006419522B1

(12) United States Patent
Bonilla

(10) Patent No.: US 6,419,522 B1
(45) Date of Patent: Jul. 16, 2002

(54) ELECTRICAL CONNECTOR ASSEMBLY

(75) Inventor: Josep Matamoros Bonilla, Tarragona (ES)

(73) Assignee: Lear Automotive (EEDS) Spain, S. L., Tarragona (ES)

( * ) Notice: Subject to any disclaimer, the term of this patent is extended or adjusted under 35 U.S.C. 154(b) by 0 days.

(21) Appl. No.: 09/631,934

(22) Filed: Aug. 3, 2000

(30) Foreign Application Priority Data

Jul. 27, 2000 (ES) ..... 9902068

(51) Int. Cl.[7] ..... H01R 13/424
(52) U.S. Cl. ..... 439/595; 439/752; 439/468
(58) Field of Search ..... 439/468, 466, 439/595, 752, 540.1

(56) References Cited

U.S. PATENT DOCUMENTS 5,071,369 A 12/1991 Denlinger et al. ..... 439/595

6,095,852 A * 8/2000 Gregory et al. ..... 43/450

* cited by examiner

*Primary Examiner*—P. Austin Bradley
*Assistant Examiner*—Alexander Gilman
(74) *Attorney, Agent, or Firm*—Oblon, Spivak, McClelland, Maier & Neustadt, P.C.

(57) ABSTRACT

An electrical connector assembly including a housing accommodating electrical terminals, a structure for locking each electrical terminal inside of the housing, a lid, a structure for maintaining the terminals in place including a locking body, and a structure for fixing the lid and the housing. The housing includes holes accommodating the electrical terminals and on which a structure for coupling the lid to the housing is included, so that there is a separation between the lid and the housing thereby allowing the wiring to pass to an outside through opposing ends of the lid. The locking body includes flanges that extend inside the housing, and mount the locking body inside the housing in a first position in which the locking body is partially outside of the housing. The flanges allow the locking body to be located at a second position where the locking body is placed completely inside the housing.

8 Claims, 6 Drawing Sheets

ELECTRICAL CONNECTOR ASSEMBLY

This Utility Model application consists, as its title indicates, of an "ELECTRICAL CONNECTOR ASSEMBLY," whose new construction, form and design characteristics meet the objective for which it was specifically designed, with maximum security and effectiveness.

Electrical connectors are known that essentially comprise a housing manufactured of an appropriate insulating material, inside of which there are electrical terminals, for example, quick connection electrical terminals. For this, said housings internally include multiple divisions that define some cavities through which the corresponding wires go.

Conventional housings include a terminal locking element to secure the terminal's position with respect to the housing. This locking element is inserted into the housing once the terminals have been correctly placed inside of the housing. The conventional structure of the locking element consists, in general terms, of a basically rectangular plate provided with some circular openings to allow wires to go through, from which two parallel plates emerge perpendicularly to the first one; these plates are both equipped with multiple ribs arranged parallel to each other, defining some grooves that match up with these openings, which serve as guides for the wiring.

Connectors that are currently known also include a closing plate equipped with multiple transverse holes that serve as guides for the wiring.

An objective of this invention consists of providing a more versatile and effective electrical connector assembly.

Another objective of the invention is to provide an electrical connector assembly that is more simply structured than the connectors that have been in use up until now for the same purpose, and which would therefore be more economical.

An electrical connector assembly in accordance with this invention comprises, along general lines:

- a housing to accommodate electrical terminals in its
- means for locking each electrical terminal inside said, housing;
- a top or lid;
- means for maintaining said terminals in position, comprising a locking body that is inserted into said housing; and
- means for fixing the lid and the housing.

The particularity of the electrical connector assembly referred to in this invention lies in the fact that said lid includes multiple transverse holes for accommodating the electrical terminals.

Thanks to this characteristic, the connector assembly of the invention dispenses with the closing plate with transverse holes to guide the wiring that conventional assemblies have. Because of this, the assembly weighs less and is simpler from a functional and construction point of view as it requires fewer parts.

Another particularity of the connector assembly that is the object of this invention lies in the fact that this assembly includes some means of coupling the lid to the housing, so that when the lid is coupled to the housing there is a separation between them, to allow the wiring to pass to the outside through the opposing ends of the lid.

In this way, the wiring follows a basically T-shaped path as it passes through the assembly referred to in this invention, a fact that positively influences the distribution of the wires.

According to one aspect of the invention, the locking body includes at least two flanges that extend inside the housing, each of whose free ends defines a projection that can be connected to a complementary projection inside the housing, with said flanges allowing the locking body to be mounted inside the housing in a first position in which said locking element is partially outside of the housing to mount the terminals, and in a second position (working position) in which the locking element is placed completely inside the housing.

The first position of the locking body allows connector assemblies to be supplied with the locking body premounted, allowing each connector assembly to be shipped and handled (the electrical terminals mounted) as if it were a single part, avoiding the use of separate packing materials for the housing and the locking body. Once the terminals have been properly mounted in the housing, the locking element can be pressed completely towards the housing, in order for it to be placed in the second position, or working position, in which it holds the terminals of the electrical connector assembly in place.

Preferably, the aforementioned means of coupling the lid to the housing comprise multiple legs that protrude downwards from the lid, whose lower ends include a hole for accommodating some projections formed in the housing.

Advantageously, the lid of the connector assembly comprises a body, basically in the shape of an inverted U in cross section, whose upper face has a central depression intended to receive said means of fixing the lid and the housing. The invention also anticipates that the means for fixing the lid consist of a screw whose head is accommodated in the aforementioned depression in the lid and whose shank will run through the inside of the locking body, fixing the lid and the housing to each other and preventing axial shifting between them.

The shank of the screw is equipped with a peripheral groove appropriately sized to accommodate a serrated washer which assists in securing the lid and the housing. The combination of a washer and a screw equipped with a groove on its shank allows the lid and the housing to be removed with the locking body placed inside the housing.

The means for coupling each terminal consist of a projection that protrudes radially through the inside of the hole in the housing, which is to hold the end of the electrical terminal in place. This arrangement allows quick and easy mounting of the terminals in the housing at the same time as guaranteeing that they will be secured.

The external geometry of said locking body is complementary to the internal geometry of the aforementioned housing, both elements being symmetrical with respect to two axes.

The characteristics and the advantages of the electrical connector assembly according to this invention will be clearer in the detailed description of the preferred embodiment of said assembly. Said description follows, by way of a non-limiting example, with reference to the accompanying drawings, in which.

In these figures, the following elements can be seen: (1) connector, (2) housing, (3) electrical terminals, (4) locking means, (5) lid, (6) locking body, (7) fixing means, (8) transverse holes, (9) leg, (10) groove, (10*a*) hole, (11) hub, (12) projections, (12*a*) guide, (13) opposing ends of the lid, (14, 15) parallel plates, (16) flange, (17) ribs, (18) cylindrical body, (19, 20) opposing flanges, (21) inside area, (22, 23) projections of the flanges, (24, 25) complementary projections, (26) body of the lid, (27) central depression, (28) slanted area, (29) flat area, (30) head of the screw, (31) shank of the screw, (32) cylindrical body, (33) serrated washer and (34) radial groove of the screw.

Figure 1:
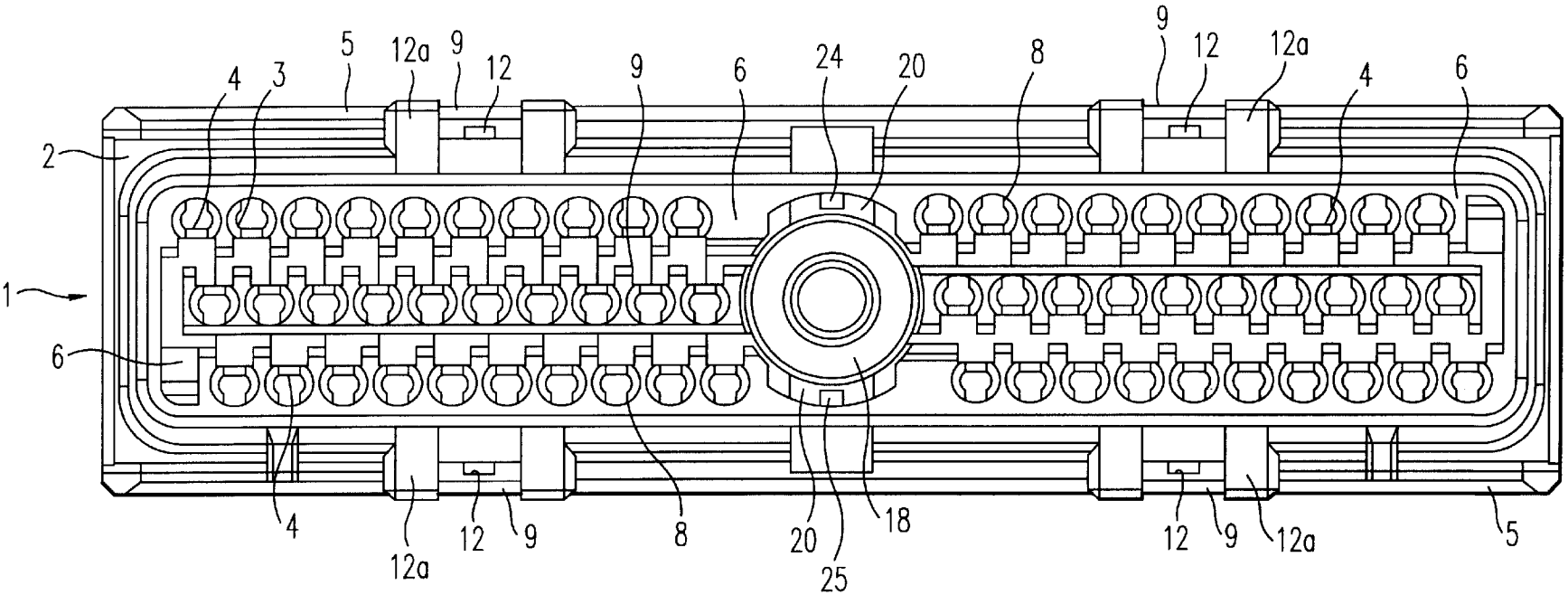
FIG. 1 is a plan view from below of a connector assembly according to this invention.
Figure 4A:
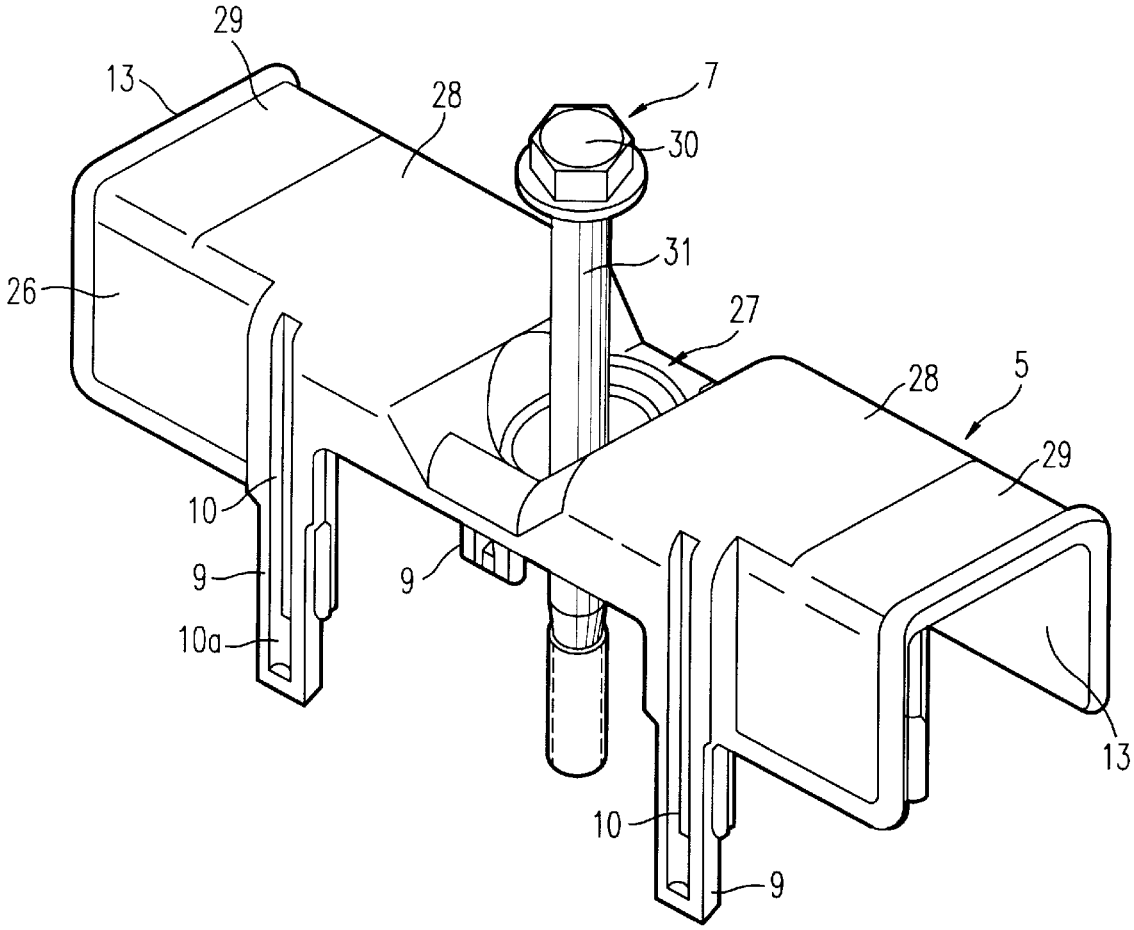
FIG. 4 is an exploded, perspective view of the connector assembly.
Figure 4B:
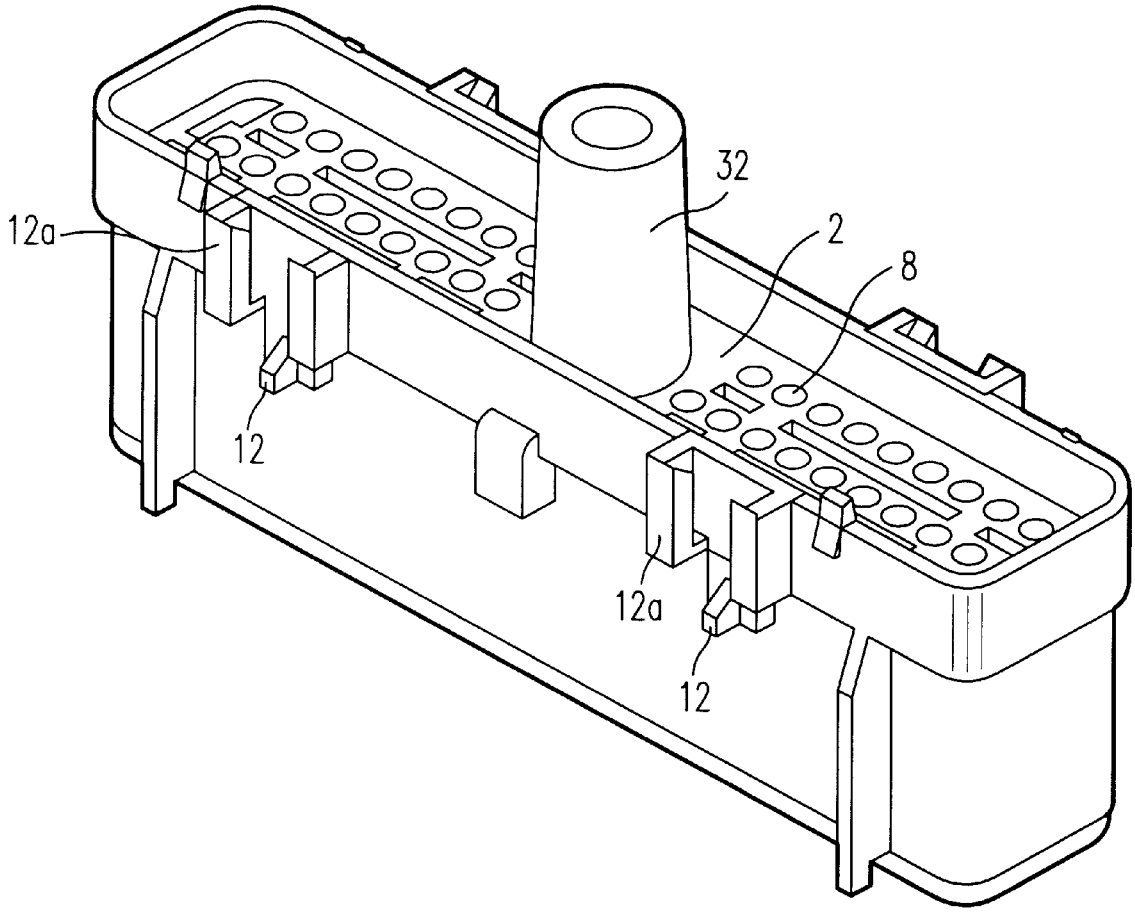
Figure 4C:
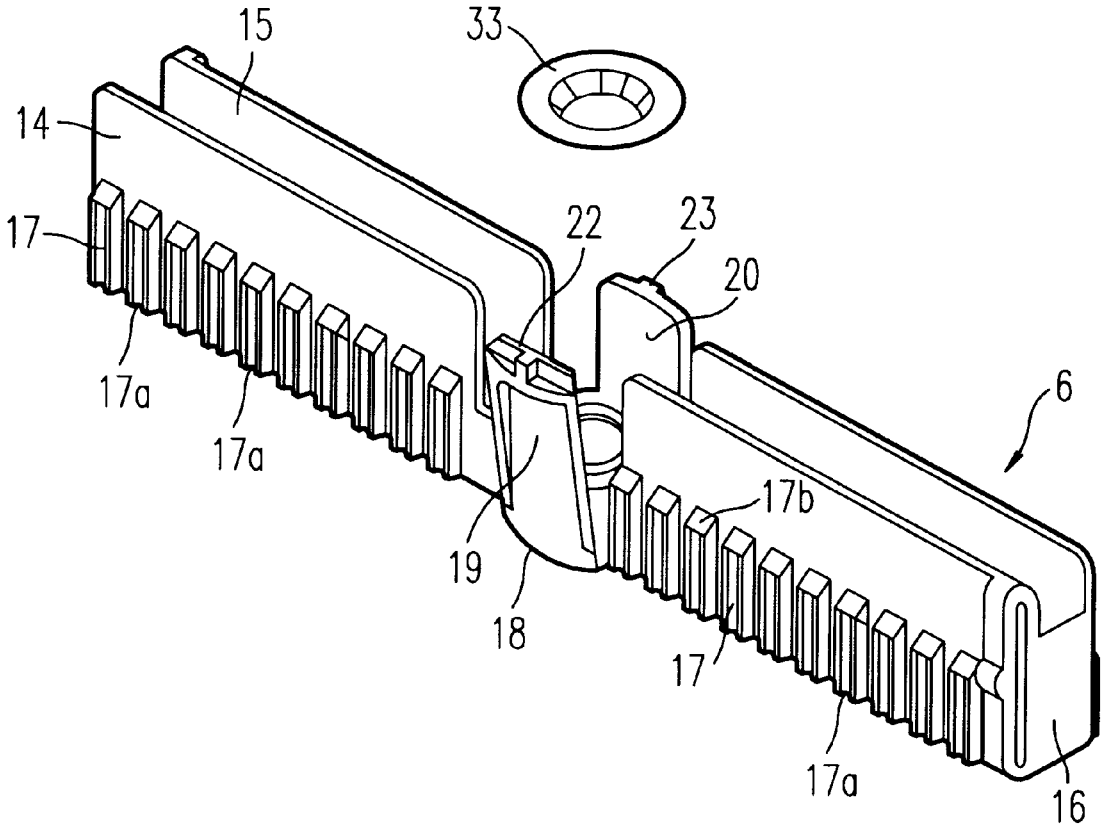

As can be seen in FIG. 4, the connector assembly (1) referred to in the invention comprises a housing (2) for accommodating some electrical terminals (3) inside of it, shown in FIG. 1. Said housing (2) incorporates means for locking (4) each electrical terminal (3) inside of it, which have also been represented in the plan view in FIG. 1.

The assembly also includes a lid (5), represented in FIGS. 2, 3 and 4; means to maintain the electrical terminals (3) in place, which comprise a locking body (6) inserted in the housing (2) and means for fixing (7) the lid (5) and the housing (2), which will be described in greater detail further on.

The lid includes multiple transverse holes (8) which accommodate electrical terminals (3) such as the one represented in FIG. 1. Four legs (9) protrude from the body of the lid (2) and extend downwards. Each leg (9) has a groove (10) and the lower ends of said legs (9) have a hole (10*a*) to accommodate some projections (12) on the housing (2). Thus, each leg (9) is made to slide so that the aforementioned projection (12) passes through the groove (10) to guide the leg (9) towards the coupling position represented in FIG. 2, in other words, that position in which the projections (12) are introduced into the respective holes (8) of each leg (9). Some guide elements (12*a*), basically U-shaped, placed on the housing (2) and on said projections (24, 25), participate in coupling the lid (5), appropriately guiding the legs (9).

Figure 3:
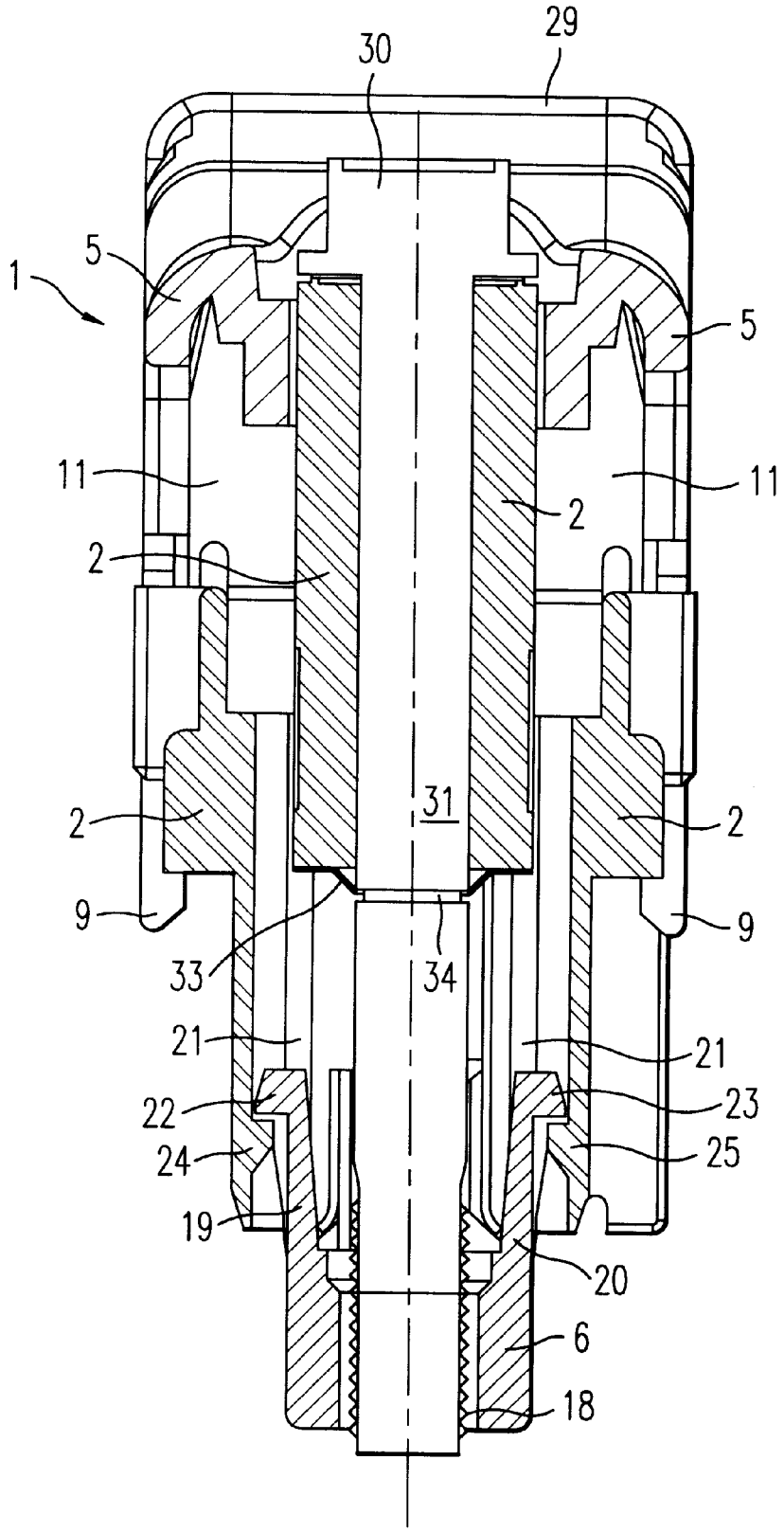
FIG. 3 is a side elevational view in cross section on the X—X plane of FIG. 2 of the embodiment of the connector assembly of the invention.

The length of said legs (9) is such that when the lid (5) is coupled to the housing (2), there is a separation designated by (11) in FIG. 3. This separation (11) allows the wiring to pass to the outside through the opposing ends (13) of the lid (5).

The locking body (6) is made up of two parallel plates (14, 15) joined by respective walls (16). Said plates (14, 15) include some ribs (17), arranged in a parallel fashion, which extend approximately to half the width of said plates (14, 15). Each rib (17) has, on the end adjacent to the outer edge of said plates (14, 15), a small projection (17*a*) whose purpose is to hold the wire in place in the hole (8) in the housing (2). The opposite end of each rib (17) ends in a slanted surface (17*b*) to facilitate mounting the locking element (4) on the housing (2).

As implied by FIG. 1, the external geometry of said locking body (6) is complementary to the internal geometry of the housing (2), both elements being symmetrical with respect to two axes.

Plates (14, 15) are interrupted at their central part by a cylindrical body (18) whose height basically corresponds to the length of said ribs (17). The cylindrical body (18) is extended by two opposing flanges (19, 20) which are to be introduced into the inside area (21) of the housing (2), as can be seen in FIG. 3. The ends of the flanges (19, 20) have some projections (22, 23) that slide through the inside (21) of the housing (2), a fact which causes the flection of flanges (19, 20), bringing them closer to each other, especially when projections (22, 23) slide on the complementary projections (24, 25) of said inside area (21) of the housing (2).

Figure 2:
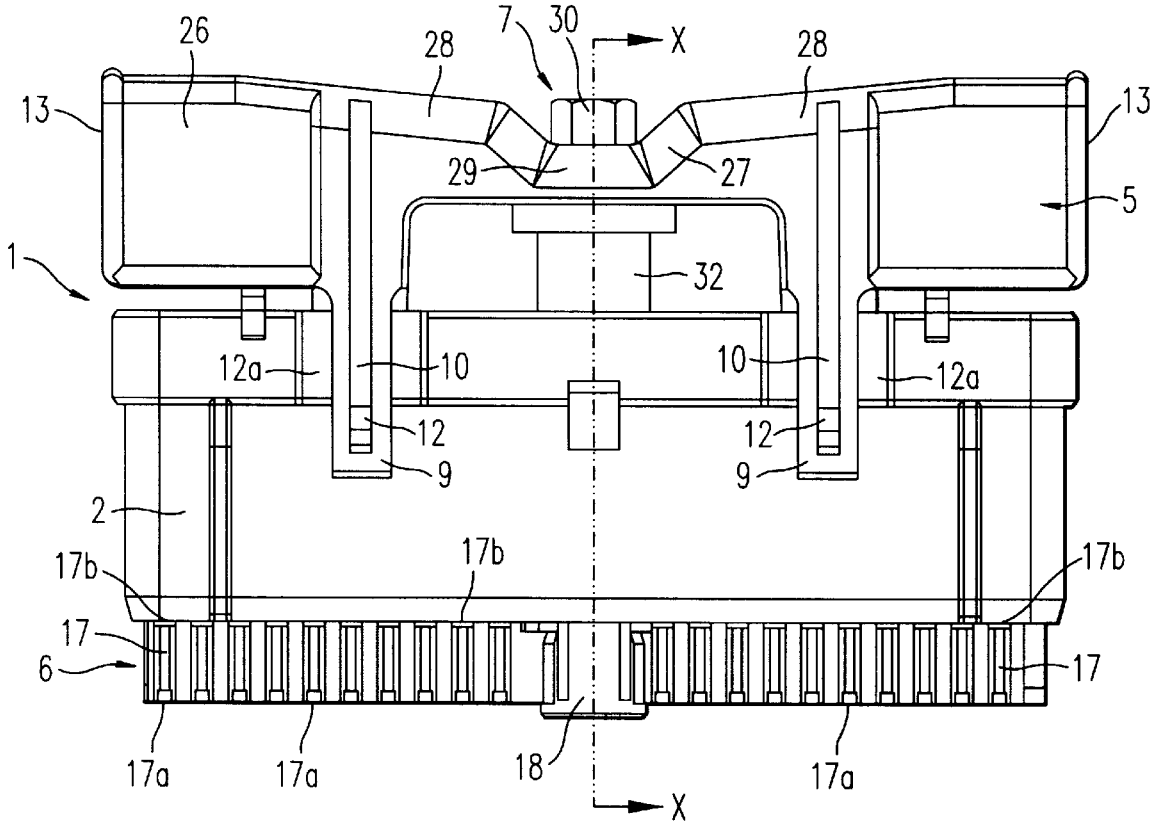
FIG. 2 is an elevational view of the connector assembly represented in FIG. 1, in which this connector assembly has been depicted with the locking element in the first position.

The structure of the flanges (19, 20) as can be seen in FIG. 3, combined with the aforementioned projections (22, 23) and the complementary projections (24, 25) allow the locking body (6) to be mounted on the inside (21) of the housing (2) in a first position, such as the one represented in FIGS. 2 and 3. In this position, the locking element (6) is partially outside of the housing (2) to facilitate the placement of the terminals (3). A second position of the aforementioned locking element (6) corresponds to the working position, in which the locking element (6) is completely inserted inside (21) the housing (2), ensuring that the aforementioned terminals (3) of the connector assembly (1) are secured.

With particular reference to FIG. 4, the lid (5) comprises a body (26) basically in the shape of an inverted U in cross section. The upper face of the body (26) of the lid (5) has a central depression (27) and an adjacent inclined area (28) on each side, which finish, at each end (13), in respective flat areas (29). The central depression (27) is intended to receive the means for fixing (7) the lid (5) and the housing (2). Said fixing means (7) consist of a screw whose head (30) is accommodated in the aforementioned central depression (27) in the lid (5) and whose shank (31) runs through the inside of the housing (2), in other words, through a cylindrical body (32) that protrudes from it and through the aforementioned inside area (21). A serrated washer (33) participates in fixing the lid (5) and the housing (2), preventing axial shifting between said elements.

In this sense, and as can be seen in the cross section in FIG. 3, the shank (31) of the screw is advantageously provided with a peripheral groove (34) to accommodate said serrated washer (33). In this way, it is possible to remove the housing by unscrewing the screw, without having the locking body (6) come out of the housing.

Without deviating from either the essence or the inventive concept of this invention as defined in the claims that follow, all the materials in the elements that make up the connector assembly of the invention, as well as the shapes, dimensions and other accessory elements, may be replaced by others that are technically equivalent.

What is claimed is:

1. An electrical connector assembly comprising:

a housing configured to accommodate electrical terminals inside of said housing;

means for locking each electrical terminal inside of said housing;

a lid;

means for maintaining said terminals in place, including a locking body inserted into said housing; and means for fixing the lid and the housing;

wherein the housing includes multiple transverse holes for accommodating the electrical terminals and on which means for coupling said lid to the housing is included, so that, when the lid is coupled to the housing, there is a separation between the lid and the housing thereby allowing the wiring to pass to an outside through opposing ends of the lid, and wherein the locking body includes at least two flanges that extend inside the housing, the at least two flanges being configured to mount the locking body inside the housing in a first position in which said locking body is partially outside of the housing, and the at least two flanges being configured to allow the locking body to be located at a second position in which the locking body is placed completely inside the housing.

2. The electrical connector assembly according to claim 1, wherein each of the at least two flanges have a free end that defines a projection which can be coupled to a complementary projection inside the housing.

3. The electrical connector assembly according to claim 1, wherein the means for coupling the lid to the housing comprise multiple legs that extend downwards, and that gave lower ends which include a hole for accommodating projections formed on the housing.

4. The electrical connector assembly according to claim 1, wherein the means for locking each electrical terminal includes a projection that protrudes radially through the inside of the hole in the housing, which hold the end of the electrical terminal in place.

5. The electrical connector assembly according to claim 1, wherein said locking body has an external geometry that is complementary to an internal geometry of the housing both the locking body and the housing being symmetrical with respect to two axes.

6. The electrical connector assembly according to claim 1, wherein the lid comprises a body generally in the shape of an inverted U in cross section, the body having an upper face with a central depression configured to receive the means for fixing the lid and the housing.

7. The electrical connector assembly according to claim 6, wherein the means for fixing the lid and the housing includes a screw having a head accommodated in the central depression in body of the lid and a shank that runs through the inside of the housing, fixing the lid and the housing to each other, and preventing axial shifting between the lid and the housing.

8. The electrical connector assembly according to claim 7, wherein the shank of the screw is equipped with a peripheral groove for accommodating a serrated washer which participates in fixing the lid and the housing.

* * * * *

UNITED STATES PATENT AND TRADEMARK OFFICE

CERTIFICATE OF CORRECTION

PATENT NO. : 6,419,522 B1
DATED : July 16, 2002
INVENTOR(S) : Bonilla

It is certified that error appears in the above-identified patent and that said Letters Patent is hereby corrected as shown below:

Title page,
Item [30], Foreign Application Priority Data should read:

-- [30] Foreign Application Priority Data
Aug. 3, 1999 (ES) …….. 9902068 --

Signed and Sealed this

Eleventh Day of February, 2003

JAMES E. ROGAN
*Director of the United States Patent and Trademark Office*